US007869730B2

(12) United States Patent
Cho

(10) Patent No.: US 7,869,730 B2
(45) Date of Patent: Jan. 11, 2011

(54) IMAGE FORMING APPARATUS HEAT CONTROL

(75) Inventor: Won Mo Cho, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 118 days.

(21) Appl. No.: 12/052,924

(22) Filed: Mar. 21, 2008

(65) Prior Publication Data

US 2008/0232838 A1 Sep. 25, 2008

(30) Foreign Application Priority Data

Mar. 22, 2007 (KR) ..... 10-2007-0028316

(51) Int. Cl.
*G03G 15/20* (2006.01)

(52) U.S. Cl. ..... 399/69; 399/67

(58) Field of Classification Search ..... 399/69, 399/67, 70

See application file for complete search history.

(56) References Cited

U.S. PATENT DOCUMENTS 5,349,377 A * 9/1994 Gilliland et al. ..... 347/131
5,708,920 A * 1/1998 Ohnishi et al. ..... 399/69
5,745,658 A * 4/1998 Gerety ..... 358/1.2
6,104,893 A * 8/2000 Byeon et al. ..... 399/66
2006/0279813 A1* 12/2006 Ozawa et al. ..... 358/538

FOREIGN PATENT DOCUMENTS

| | | |
|---|---|---|
| CN | 1704855 | 12/2005 |
| JP | 03-83662 | 4/1991 |
| JP | 2005-043821 | 2/2005 |

OTHER PUBLICATIONS

Chinese Office Action issued Nov. 6, 2009 in CN Application No. 200810086828.8.

* cited by examiner

*Primary Examiner*—David M Gray
*Assistant Examiner*—Rodney Bonnette
(74) *Attorney, Agent, or Firm*—Stanzione & Kim, LLP

(57) ABSTRACT

An image forming apparatus and method includes a controller to set a reference fusing temperature according to the print pattern of an input image received from an image input unit. The input image is converted to bitmap data to recognize the print pattern. The reference fusing temperature is set higher as the transition rate of the converted bitmap data increases. When printing an image whose print pattern has a low transition rate, the apparatus reduces the time required to print the first page of the image, thereby improving the print speed over the conventional apparatus.

24 Claims, 11 Drawing Sheets

IMAGE FORMING APPARATUS HEAT CONTROL

CROSS-REFERENCE TO RELATED APPLICATIONS

This application claims the benefit under 35 U.S.C. §119 (a) from Korean Patent Application No. 2007-0028316, filed on Mar. 22, 2007 in the Korean Intellectual Property Office, the disclosure of which is incorporated herein by reference in its entirety.

BACKGROUND OF THE INVENTION

1. Field of the Invention

The present general inventive concept relates to an image forming apparatus and a method to control the same, wherein a fusing temperature is controlled according to a print pattern of an input image to improve a print speed of the image forming apparatus.

2. Description of the Related Art

An image forming apparatus, such as a general printer or a multifunction printer, performs a fusing process to apply heat and pressure to a print sheet with a toner image transferred thereto in order to fix the toner image to the print sheet. The fusing process is important in forming a high quality image.

When power is supplied to the image forming apparatus, a preheat process is performed to provide heat until a preset fusing temperature is reached. The fusing temperature directly affects the fusing performance of the image forming apparatus.

According to a conventional method, the fusing process is performed after a specific fusing temperature is reached, which imposes a limitation to increasing a print speed. For example, a print time required to print a first page after a fusing heater is preheated is constant in the conventional method. Accordingly, the print time is extended.

In an effort to solve this problem, a number attempts have been made to reduce the print time required to perform printing in response to a print command from the user.

One solution to reduce the print time of the first page of the input image to increase the print speed is ceramic heating using a ceramic-coated heating roller to rapidly raise the fusing temperature. Although the ceramic heating can reduce the preheat time compared to the conventional method, the ceramic heating increases a financial burden due to use of expensive parts of the ceramic heating.

SUMMARY OF THE INVENTION

The present general inventive concept provides an image forming apparatus and a method to control the same, wherein a different fusing temperature is set according to a print pattern of an input image, thereby improving a print speed.

Additional aspects and/or advantages of the general inventive concept will be set forth in part in the description which follows and, in part, will be obvious from the description, or may be learned by practice of the general inventive concept.

The foregoing and/or other aspects and utilities of the present general inventive concept may be achieved by providing an image forming apparatus including a fuser including a fusing heater; an image input unit to provide an input image; and a controller to control print speed according to a print pattern of the input image.

The controller may set a different reference fusing temperature according to the print pattern to apply a different preheat time of the fusing heater according to the print pattern.

The controller may recognize the print pattern according to the amount of heat energy that the fusing heater generates to melt toner particles of the input image.

The controller may include a data processor to convert the input image to binary data; a transition rate calculator to calculate a transition rate of the binary data; a temperature setter to set a reference fusing temperature corresponding to a print pattern recognized according to the transition rate, and a comparator to compare a fusing temperature changing as the fusing heater operates with the reference fusing temperature to control the fusing heater.

The transition rate calculator may define the transition rate using the number of dots and the number of transitions of the input image as follows:

$$\text{Transition Rate}=(\text{Number of Transitions})/(\text{Number of Dots}).$$

The temperature setter may set the reference fusing temperature higher as the transition rate increases.

The forming apparatus may further include a fusing temperature detector to detect the fusing temperature changing as the fusing heater operates, wherein the comparator receives the detected fusing temperature from the fusing temperature detector.

The data processor may convert the input image to bitmap data.

The foregoing and/or other aspects and utilities of the present general inventive concept may also be achieved by providing an image forming apparatus including a fusing heater, an image input unit to provide an input image, a data processor to convert the input image to bitmap data, a fusing temperature detector to detect a fusing temperature changing as the fusing heater operates, and a controller to recognize a print pattern of the input image according to a transition rate of the bitmap data, to set a reference fusing temperature used to preheat the fusing heater according to the recognized print pattern, and to compare the detected fusing temperature with the reference fusing temperature to control the fusing heater.

The fusing temperature controller may recognize one of a black pattern, a character pattern, and a graphic pattern as the print pattern.

The foregoing and/or other aspects and utilities of the present general inventive concept may also be achieved by providing a method to control an image forming apparatus including a fusing heater, the method including receiving an input image, setting a reference fusing temperature according to a print pattern of the input image, activating the fusing heater to preheat the fusing heater, and controlling an operation of the fusing heater so that a fusing temperature changing as the fusing heater operates reaches the set reference fusing temperature.

The setting of the reference fusing temperature may include converting an input image to bitmap data, calculating a transition rate of the bitmap data, and setting the reference fusing temperature higher as the calculated transition rate increases.

The controlling of the operation of the fusing heater may include deactivating the fusing heater when the fusing temperature has reached the reference fusing temperature and introducing a print sheet into a fuser to perform a fusing process of the print sheet.

The foregoing and/or other aspects and utilities of the present general inventive concept may also be achieved by providing a method to control an image forming apparatus including a fusing heater, the method including converting an input image to bitmap data; calculating a transition rate of the bitmap data; recognizing a print pattern of the input image according to the transition rate and setting a reference fusing temperature according to the recognized print pattern; detecting a fusing temperature changing as the fusing heater operates, comparing the detected fusing temperature with the set reference fusing temperature, and controlling the fusing heater according to the comparison.

The transition rate may be calculated using the number of dots and the number of transitions of the bitmap data.

The foregoing and/or other aspects and utilities of the present invention general inventive concept may also be achieved by providing an image forming apparatus including a fuser to fuse an image transferred to a printing medium, and a controller to control the fuser according to a print pattern of the image.

The controller may control a print speed according to the print pattern of the image.

The fuser may include a heater, and the controller may set a heating temperature variable according to the print pattern of the image and may control the heater according to the set heating temperature.

The image forming apparatus may further include an image forming unit to form the image and to transfer the image to the printing medium, a print speed may correspond to an image forming period of the image forming unit and an image fusing period of the fuser, the image fusing time may vary according to the print pattern of the image, and the print speed may be controlled according to the variable image fusing period.

The image forming apparatus may further include an image forming unit to form the image and to transfer the image to the printing medium, the fuser may perform a heating operation at a heating start time, the image forming unit may perform an image forming operation at an image forming start time, and a time span between the heating start time and the image forming start time may vary according to the print pattern of the image.

The print pattern may include at least one of the number of transitions within the image, the number of dots within the image, a density in a predetermined area of the image, a distance between toner particles, and a length of toner particles The foregoing and/or other aspects and utilities of the present invention general inventive concept may also be achieved by providing an image forming apparatus including an image forming unit to form an image and to transfer the formed image to a printing medium, a fuser having a heater to fuse the transferred image on the printing medium, and a controller to control a heating time of the heater according to a pattern of the image.

The controller may set a heating temperature of the heater to reduce the heating time.

The foregoing and/or other aspects and utilities of the present invention general inventive concept may also be achieved by providing an image forming apparatus including an image forming unit to form an image at an image forming start time and to transfer the formed image to a printing medium, a fuser having a heater to preheat the heater at a preheating start time and to fuse the transferred image on the printing medium, and a controller to control a difference between the preheating start time of the heater and the image forming start time of the image forming unit according to a pattern of the image.

The controller may set a heating temperature of the heater to reduce the difference.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
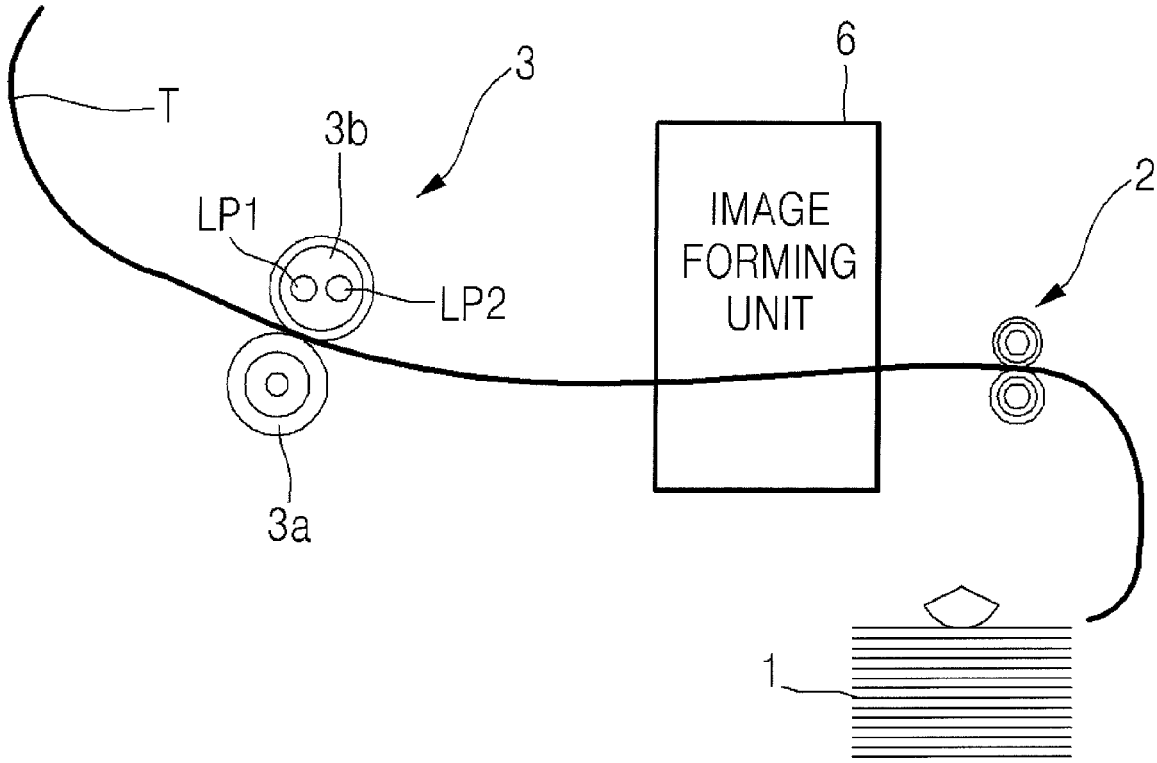
FIG. 1 illustrates an image forming apparatus having a fuser provided in a conveyance path of print sheets.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

As illustrated in FIG. 1, an image forming apparatus includes a pickup unit and a registration roller 2 mounted on an upstream of a conveyance path T to pick-up, feed, and convey printing media, such as print paper 1, sheet by sheet, an image forming unit 6 to perform development and transfer processes to form and/or transfer an image on the print paper 1. Then, the image transferred to the print sheet 1 is fused while passing through a fuser 3.

The fuser 3 includes a pressure roller 3*a* and a heating roller 3*b* that are mounted opposite each other to apply heat and pressure to the print sheet 1. The heating roller 3*b* includes one or more fusing heaters LP1 and LP2 that are mounted in the heating roller 3*b* parallel to each other in the lengthwise direction of the heating roller 3*b*. A halogen lamp may be used as each of the fusing heaters LP1 and LP2.

Figure 2:
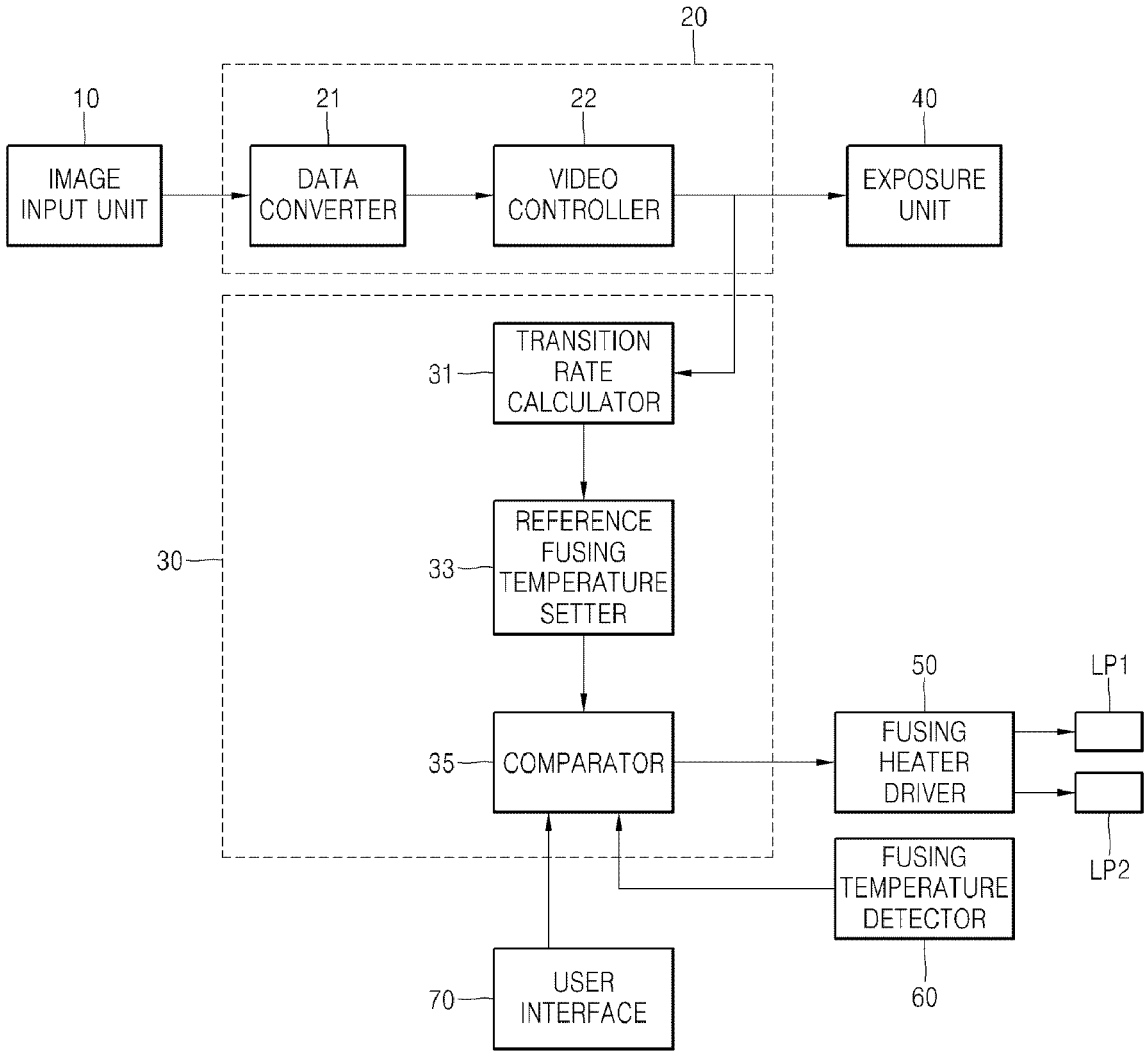
FIG. 2 is a block diagram illustrating the image forming apparatus of FIG. 1 according to an embodiment of the present general inventive concept.

FIG. 2 is a block diagram illustrating an image forming apparatus according to an embodiment of the present general inventive concept.

As illustrated in FIGS. 1 and 2, the image forming apparatus according to the present embodiment includes an image input unit 10, a data processor 20, a fusing temperature controller 30, an exposure unit 40, a fusing heater driver 50, a fusing temperature detector 60, and a user interface 70.

The image forming unit 6, the fuser 3, and the exposure unit 40 may be referred to as an image forming unit to form an image on the conveyed printing paper 1. The data process 20 and the fusing temperature controller 30 may be referred to as a controller to control the fuser 3 according to an operation of the fusing heater driver 50 and the fusing temperature detector 60.

The image input unit 10 provides a scanned image produced by a scanner or an image received through a host computer to the data processor 20, which includes a data converter 21 and a video controller 22.

The data converter 21 converts color component data of the input image provided from the image input unit 10 to print data and provides the print data to the video controller 22.

The video controller 22 converts the print data to bitmap data used to form a print image and provides the bitmap data to the exposure unit 40.

The exposure unit 40 emits a light beam through a light source according to the bitmap data to form an electrostatic image on a photosensitive drum. The electrostatic image is then subjected to development, transfer, and fusing processes to form a print image.

The bitmap data provided from the video controller 22 to the exposure unit 40 is a sequence of data, such as 0s and/or 1s. Changing from 0 to 1 or from 1 to 0 in the sequence is referred to as transition.

Figure 3A:
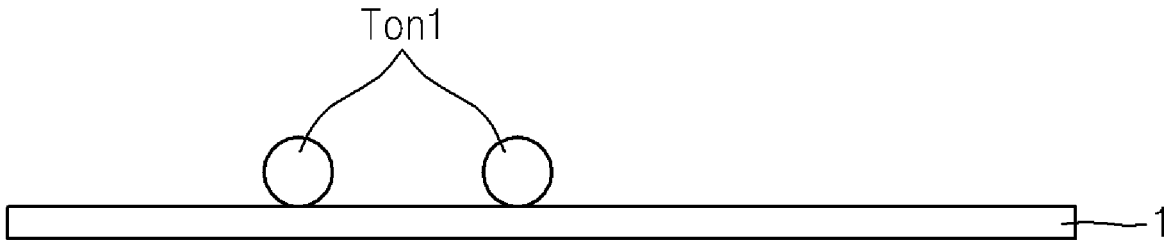
FIG. 3A illustrates toner particles that are sparsely attached to a print sheet before being fused.
Figure 4A:
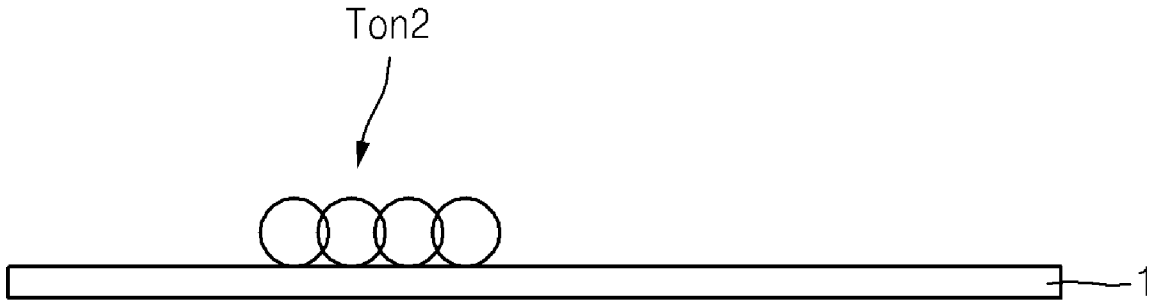
FIG. 4A illustrates toner particles that are densely attached to a print sheet before being fused.

If transition occurs a great number of times in the bitmap data, toner particles Ton1 to form an image are sparsely attached to the print sheet 1 as illustrated in FIG. 3A. On the other hand, if transition occurs a small number of times in the bitmap data, toner particles Ton2 to form an image are densely attached to the print sheet 1 as illustrated in FIG. 4A.

The fusing heater driver 50 drives the fusing heaters LP1 and LP2 under control of the fusing temperature controller 30 described later to fix the toner particles attached to the print sheet.

Figure 3B:
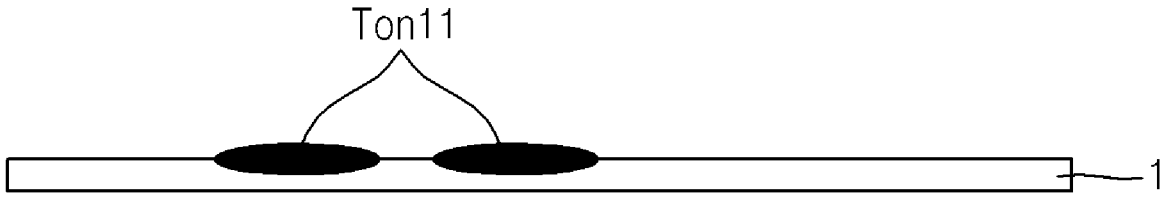
FIG. 3B illustrates toner particles that are sparsely attached to a print sheet after being fused.
Figure 4B:
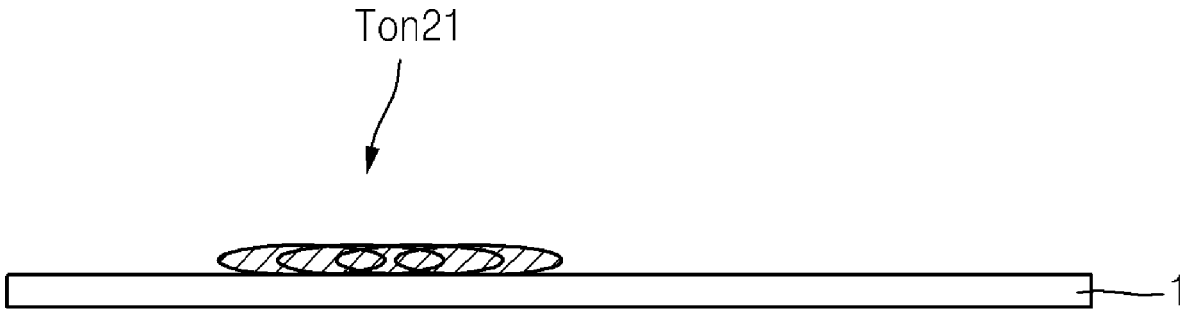
FIG. 4B illustrates toner particles that are densely attached to a print sheet after being fused.

As the fusing process is performed on the print sheet, heat energy generated by the fusing heaters LP1 and LP2 is applied to the toner particles on the print sheet. Accordingly, the toner particles Ton1 illustrated in FIG. 3A are changed to toner particles Ton11 fixed to the print sheet as shown in FIG. 3B. Likewise, the toner particles Ton2 illustrated in FIG. 4A are changed to toner particles Ton21 fixed to the print sheet as shown in FIG. 4B.

High heat energy may be required to fuse the toner particles Ton1 sparsely attached to the print sheet 1, and relatively low heat energy may be required to fuse the toner particles Ton2 densely attached to the print sheet 1.

Input images are classified according to print patterns. Examples of the print pattern may include a gray pattern of a graphic image illustrated in FIG. 5A, a totally black pattern illustrated in FIG. 5B, and a character pattern illustrated in FIG. 5C.

Figure 5A:
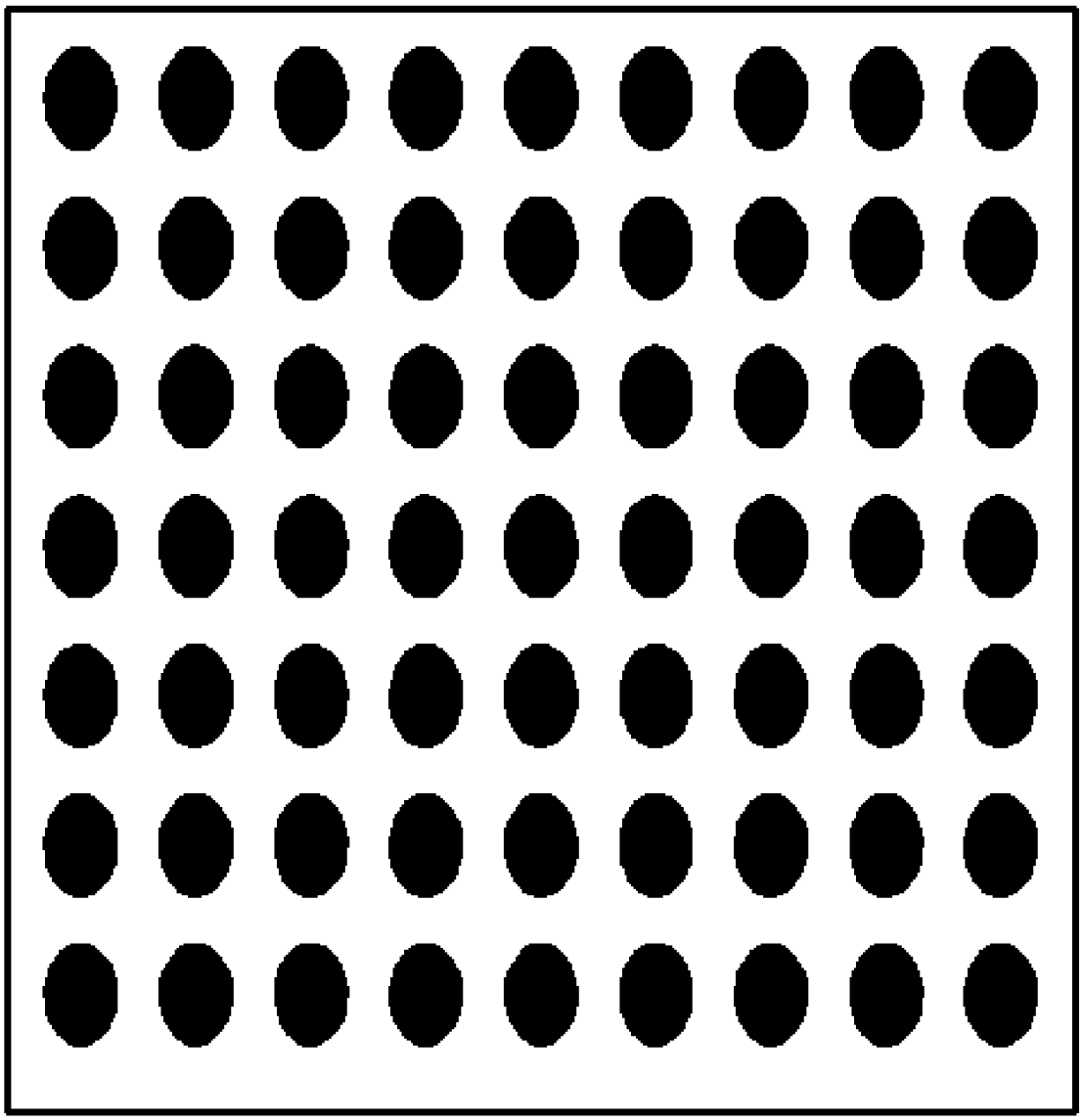
FIG. 5A illustrates an example print pattern whose transition rate is very high.
Figure 5B:
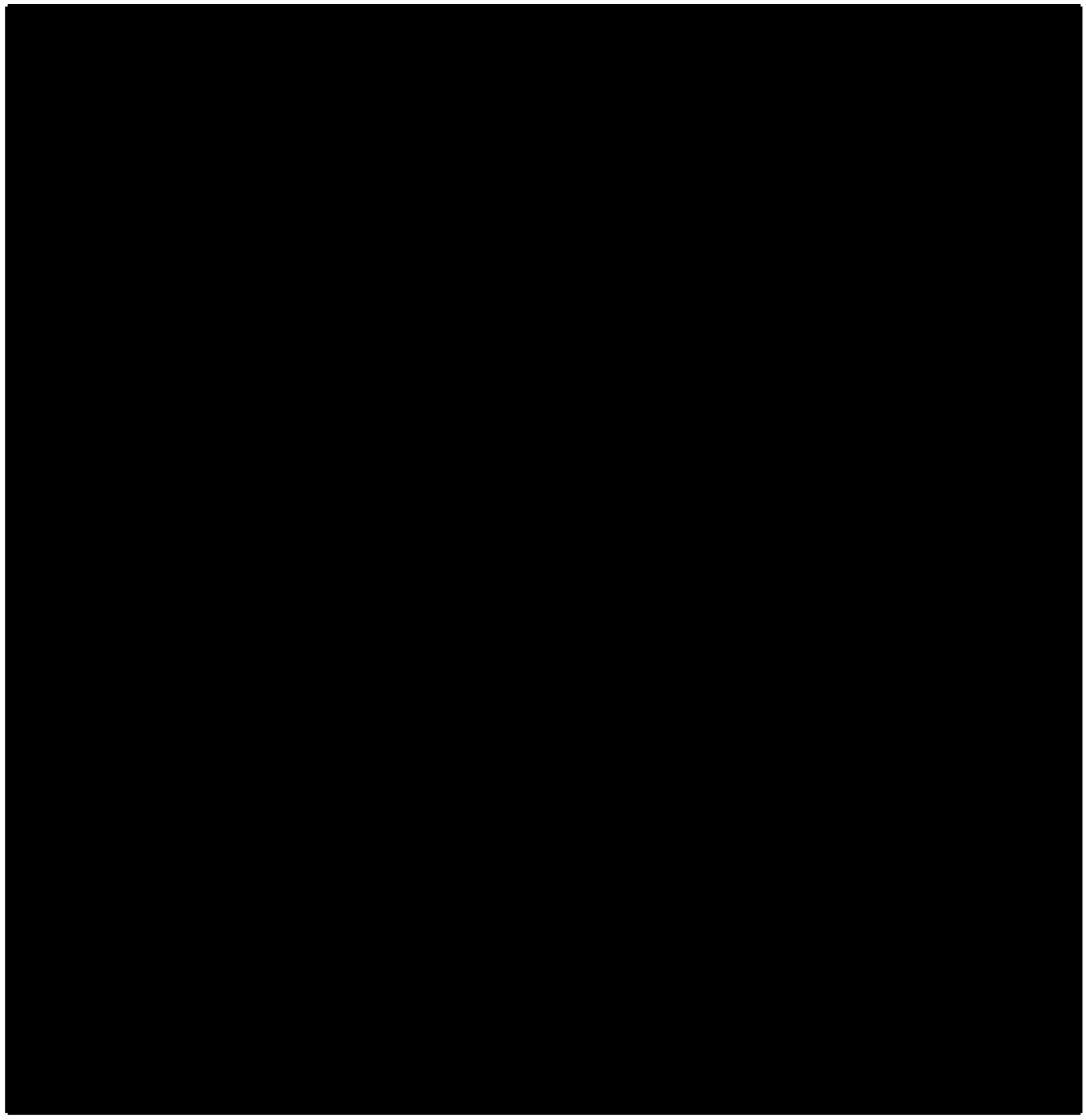
FIG. 5B illustrates an example print pattern whose transition rate is zero.
Figure 5C:
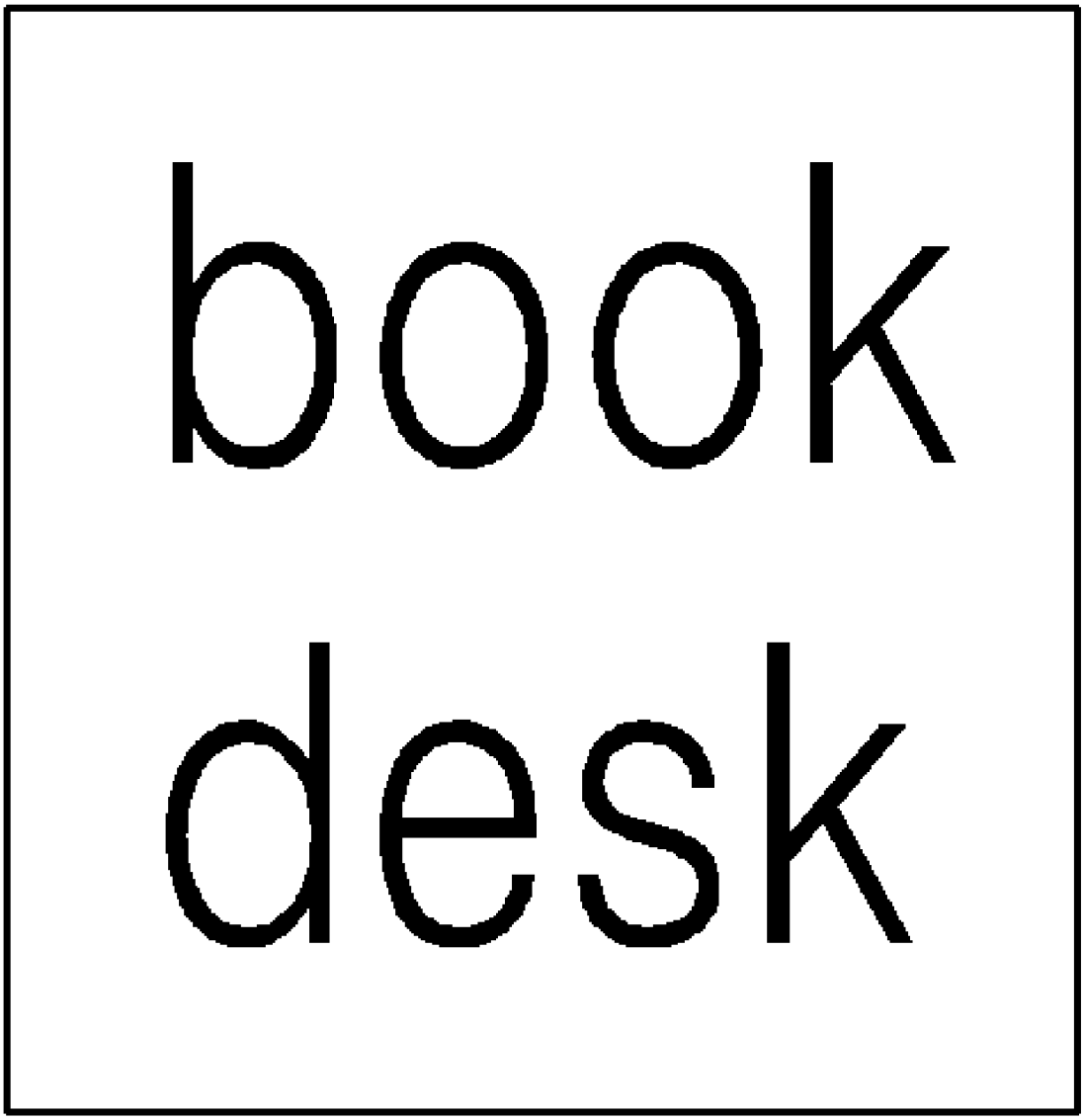
FIG. 5C illustrates an example print pattern whose transition rate is low.

Although FIGS. 5A-5C illustrate the print patterns, the print pattern is not limited thereto. The print pattern may be a difference in color and/or density in a predetermined area or a predetermined direction of the print paper.

A transition rate TR of an input image can be defined as follows, based on the number of dots and/or the number of transitions in a sequence of data of 0s and 1s which constitutes bitmap data of the input image.

Transition Rate TR=(Number of Transitions)/(Number of Dots)

For example, the gray pattern of FIG. 5A has a TR of 0.4-0.9 such that transition occurs a large number of times, the totally black pattern of FIG. 5B has a TR of 0-0.1 such that the image is totally black, and the character pattern of FIG. 5C has a TR of 0.2-0.3 such that transition occurs a relatively small number of times. Accordingly, the transition rate TR may be a factor to identify a print pattern of the input image.

Although FIGS. 3A-5C illustrate the print pattern and the transition rate TR, the present general inventive concept is not limited thereto. The transition rate TR may represent a distance between toner particles or toner images which may be disposed adjacent to each other. For example, the translation rate TR may be calculated by the number of data of 0s between the adjacent data of 1s or the number of data 1a between the adjacent data of 0s. The number of data of 0s may represent a distance between the toner particles of FIG. 3A or 4A. The number of the data of 1s may represent a length of the toner particles in a predetermined direction, e.g., a widthwise line direction of the print paper. The number of data 0s and/or 1s may represent the density that can be used to calculate the transition rate TR.

The fusing temperature controller 30 according to the present embodiment includes a transition rate calculator 31, a reference fusing temperature setter 33, and a comparator 35.

The transition rate calculator 31 receives the bitmap data output from the video controller 22 and calculates a transition rate of the input image using the number of dots and the number of transitions of the bitmap data.

Figure 6:
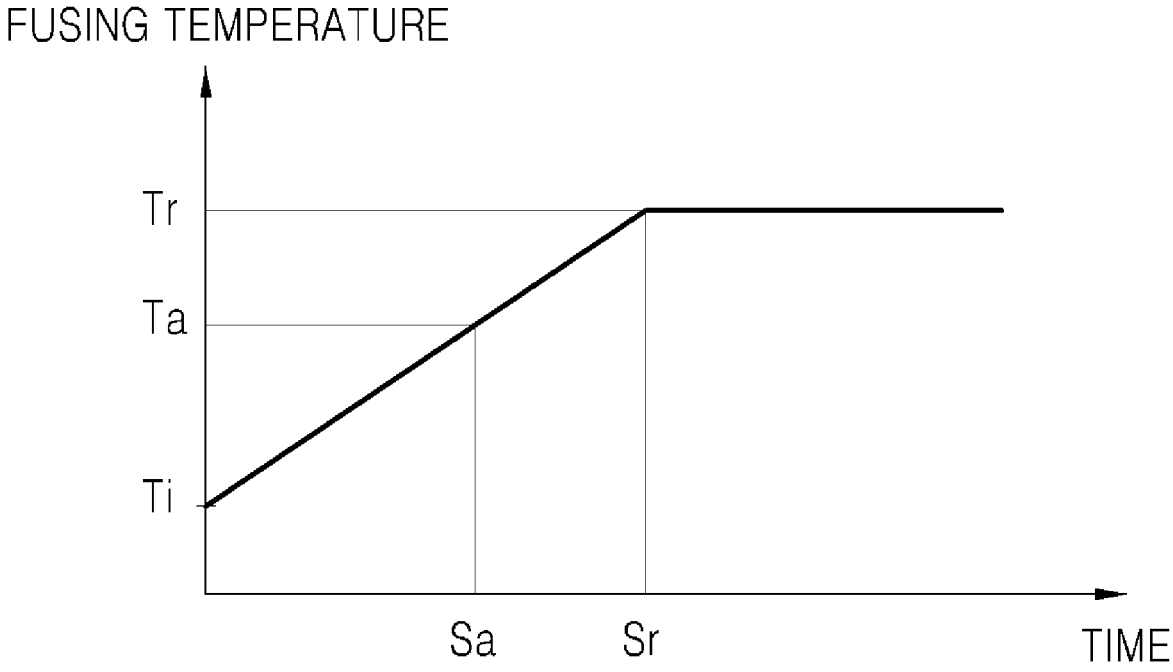
FIG. 6 is a graph illustrating reference fusing temperatures, which are set based on transition ratios, and corresponding preheat times according to the present invention.
Figure 7:
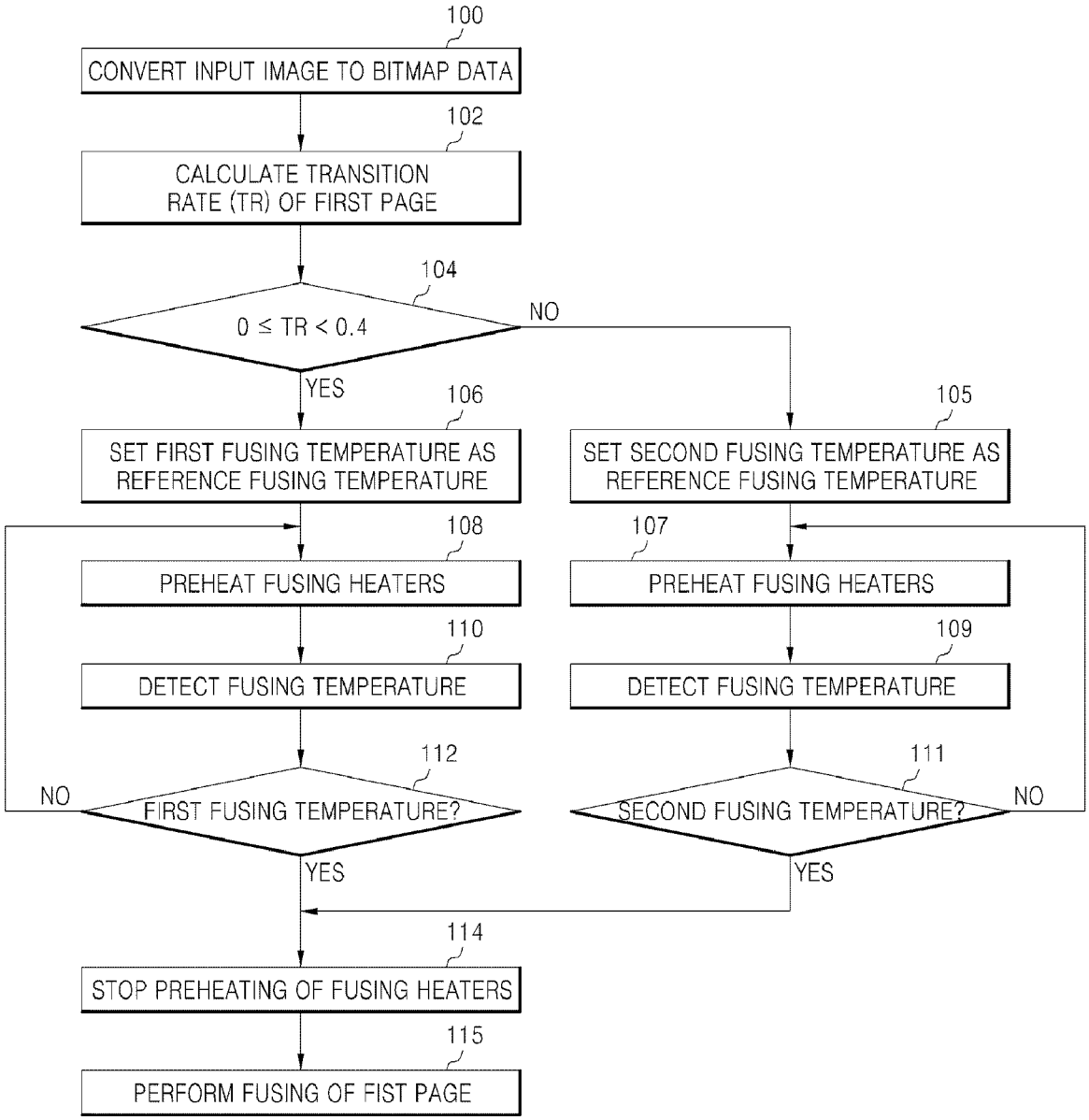
FIG. 7 is a flow chart illustrating a method to control an image forming apparatus according to the present general inventive concept.

The reference fusing temperature setter 33 recognizes a print pattern of the input image based on the calculated transition rate and sets a different reference fusing temperature according to the print pattern. Here, the term "reference fusing temperature" is referred to as a temperature at which the fusing heaters will achieve a desired fusing performance when they are heated. As illustrated in FIG. 6, if the transition rate is low, the reference fusing temperature setter 33 sets a first fusing temperature Ta, which requires a short heating time, as the reference fusing temperature since relatively low heat energy is required and, if the transition rate is high, the reference fusing temperature setter 33 sets a second fusing temperature Tr, which requires a long heating time, as the reference fusing temperature since relatively high heat energy is required. For example, the reference fusing temperature setter 33 sets the second fusing temperature Tr as the reference fusing temperature for the graphic pattern of FIG. 5A and sets the first fusing temperature Ta as the reference fusing temperature for both the totally black pattern of FIG. 5B and the character pattern of FIG. 5C.

In response to a print command input through the user interface 70, the comparator 35 provides a heater control signal, which is to control the fusing heaters, to the fusing heater driver 50. Specifically, the comparator 35 compares a fusing temperature detected by the fusing temperature detector 60 with a reference fusing temperature set by the reference fusing temperature setter 33 and applies the heater control signal to the fusing heater drive 50 to turn on or off the fusing heaters according to the comparison, to the fusing heater driver 50. The fusing heater driver 50 drives the fusing heaters LP1 and LP2 according to the heater control signal.

The fusing heaters LP1 and LP2 are deactivated when the set reference fusing temperature is reached and the print sheet with a toner image transferred thereto is then introduced into the fuser 3 to perform a fusing process.

According to the present embodiment, it is possible to significantly reduce an initial print time that is required to print the first page of an input image when power is supplied. Here, the image forming apparatus does not require a conventional period of time to perform the image transferring process or toner image forming process until the conventional heating process is completed. Since the heating time varies according to the transition rate TR, a print speed taken to form and/or fuse an image on the printing sheet can be shortened according to the variable heating time.

For example, if the transition rate of the input image is lower than a reference value (for example, 0.4), the fusing process can be started when the fusing temperature has reached the first fusing temperature Ta, which is set relatively low, from the initial temperature Ti as illustrated in FIG. 6. Here, a preheat time Sa required to reach the first fusing temperature Ta is shorter than a preheat time Sr required to fuse a general graphic pattern image, so that the print time required to print the first page is reduced by the time difference between the preheat times Sa and Sr.

In the present embodiment, a different reference fusing temperature can be set according to the print pattern of an input image to perform the fusing process not only in the case where power supply is initiated to preheat the fusing heaters but also in the case where the fusing heaters are driven to respond to a print command in a standby mode, to which the image forming apparatus has been switched after power is supplied. Accordingly, also in the latter case, the present embodiment can reduce the print time required to print the first page.

Reference will now be made to a method to control the image forming apparatus according to the present general inventive concept that is constructed as described above.

Referring to FIGS. 1-7, when power is supplied to the image forming apparatus, the apparatus converts an input image received through the image input unit 10 to bitmap data using the data processor 20 (100).

The transition rate calculator 31 calculates a transition rate (TR) of the input image using the number of dots and/or the number of transitions of the bitmap data (102).

The reference fusing temperature setter 33 determines whether or not the calculated transition rate is lower than a reference value of 0.4 (104). If it is determined that the calculated transition rate is lower than the reference value 0.4, the reference fusing temperature setter 33 recognizes that the input image corresponds to a totally black image as illustrated in FIG. 5B or a character pattern as illustrated in FIG. 5C and sets the first fusing temperature Ta, which is relatively low, as the reference fusing temperature according to the recognition (106).

The comparator 35 outputs a heater control signal to drive the fusing heaters LP1 and LP2 to preheat the fusing heaters LP1 and LP2 (108) and the fusing temperature detector 60 detects a surface temperature of the heating roller 3*b* heated by the fusing heaters LP1 and LP2 and provides the detected surface temperature to the comparator 35 (110).

The comparator 35 determines whether or not the detected fusing temperature has reached the first fusing temperature Ta (112) and proceeds to operation 108 to continue the heating operation if it is determined that the detected fusing temperature has not reached the first fusing temperature Ta.

If it is determined in operation 104 that the calculated transition rate is not lower than the reference value 0.4, the reference fusing temperature setter 33 recognizes that the input image corresponds to a graphic pattern as illustrated in FIG. 5A and sets the second fusing temperature Tr, which is relatively high, as the reference fusing temperature according to the recognition (105).

The comparator 35 outputs a heater control signal to drive the fusing heaters LP1 and LP2 to preheat the fusing heaters LP1 and LP2 (107) and the fusing temperature detector 60 detects a surface temperature of the heating roller 3*b* heated by the fusing heaters LP1 and LP2 and provides the detected surface temperature to the comparator 35 (109).

The comparator 35 determines whether or not the detected fusing temperature has reached the second fusing temperature (111) and proceeds to operation 107 to continue the heating operation if it is determined that the detected fusing temperature has not reached the second fusing temperature Tr.

If it is determined in operation 111 that the detected fusing temperature has reached the second fusing temperature Tr or if it is determined in operation 112 that the detected fusing temperature has reached the second fusing temperature Ta, the controller 35 provides a heater control signal, which is to stop the preheating operation of the fusing heaters LP1 and LP2, to the fusing heater driver 50, which then causes the fusing heaters LP1 and LP2 to stop heating according to the heater control signal (114).

When the reference fusing temperature has been reached through the preheating operation of the fusing heaters in this manner, the print sheet is introduced into the fuser to perform a fusing process of the first page and the print sheet corresponding to the first page, which has been subjected to the fusing process, is then discharged out of the apparatus (115).

As is apparent from the above description, the present general inventive concept can set a different temperature according to the print pattern of an input image so that, when an image with a low transition rate is printed, it is possible to decrease the time required to reach a fusing temperature by setting the fusing temperature relatively low, thereby reducing the print time required to print the first page by the decrease in the time required to reach the fusing temperature, thereby improving the print speed over the conventional method.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus comprising:

a fuser to fuse an image transferred to a printing medium; and a controller to control the fuser according to a recognized print pattern within the image, wherein the controller includes a data processor to convert an input image to binary data and a transition rate calculator to calculate a transition rate from the binary data and to define the transition rate using the number of dots and the number of transitions of the input image according to the following formula:

Transition Rate=(Number of Transitions)/(Number of Dots).

2. The image forming apparatus according to claim 1, wherein:

the fuser comprises a fusing heater; and the controller sets a reference fusing temperature according to the recognized print pattern and preheats the fusing heater to the reference temperature.

3. The image forming apparatus according to claim 1, wherein:

the fuser comprises a fusing heater; and the controller recognizes the print pattern and controls in accordance thereto an amount of heat energy that the fusing heater generates to melt toner particles to fuse the print pattern to the printing medium.

4. The image forming apparatus according to claim 3, further comprising:

an image input unit to provide the input image corresponding to the image, wherein the controller includes a temperature setter to set a reference fusing temperature corresponding to the print pattern recognized from the transition rate, and a comparator to compare a fusing temperature changing as the fusing heater operates with the reference fusing temperature to control the fusing heater.

5. The image forming apparatus according to claim 4, wherein the temperature setter sets the reference fusing temperature higher as the transition rate increases.

6. The image forming apparatus according to claim 4, further comprising:

a fusing temperature detector to detect the fusing temperature changing as the fusing heater operates, wherein the comparator receives the detected fusing temperature from the fusing temperature detector.

7. The image forming apparatus according to claim 4, wherein the data processor converts the input image to bitmap data.

8. The image forming apparatus according to claim 1, wherein the controller controls a print speed according to the recognized print pattern within the image.

9. The image forming apparatus according to claim 1, wherein the fuser, comprises a heater, and the controller sets a heating temperature variable according to the print pattern of the image and controls the heater according to the set heating temperature.

10. The image forming apparatus according to claim 1, further comprising:

an image forming unit to form the image and to transfer the image to the printing medium at a print speed, wherein:

the print speed corresponds to an image forming period of the image forming unit and an image fusing period of the fuser, the image fusing period varies according to the print pattern within the image, and the print speed is controlled according to the variable image fusing period.

11. The image forming apparatus according to claim 1, further comprising:

an image forming unit to form the image and to transfer the image to the printing medium over a time span, wherein:

the fuser performs a heating operation at a heating start time, the image forming unit performs an image forming operation at an image forming start time, and the time span is that between the heating start time and the image forming start time and is controlled according to the recognized print pattern within the image.

12. The image forming apparatus according to claim 1, wherein the print pattern is recognized from at least one of the number of transitions within the image, the number of dots within the image, a density in a predetermined area of the image, a distance between toner particles, and a length of toner particles.

13. The image forming apparatus according to claim 1, further comprising:

an image input unit to provide an input image corresponding to the image;

a data processor to convert the input image to bitmap data; and a fusing temperature detector to detect a fusing temperature changing as the fusing heater operates, wherein the fuser comprises a fusing heater, and the controller recognizes the print pattern within the input image according to a transition rate of the bitmap data, sets a reference fusing temperature used to preheat the fusing heater according to the recognized print pattern, and compares the detected fusing temperature with the reference fusing temperature to control the fusing heater.

14. The image forming apparatus according to claim 13, wherein the controller recognizes the print pattern as one of a black pattern, a character pattern, and a graphic pattern.

15. A method to control an image forming apparatus including a fusing heater, the method comprising:

fusing an image transferred to a printing medium using a fuser;

controlling the fuser according to a recognized print pattern within the image;

setting a reference fusing temperature according to the recognized print pattern within an input image;

converting the input image to bitmap data; and calculating a transition rate of the bitmap data to define the transition rate using the number of dots and the number of transitions of the input image according to the following formula:

Transition Rate=(Number of Transitions)/(Number of Dots).

16. The method according to claim 15, further comprising:

receiving the input image corresponding to the image;

activating a fusing heater of the fuser to preheat the fusing heater; and controlling an operation of the fusing heater so that a fusing temperature changing as the fusing heater operates reaches the set reference fusing temperature.

17. The method according to claim 16, wherein setting the reference fusing temperature includes setting the reference fusing temperature higher as the calculated transition rate increases.

18. The method according to claim 16, wherein controlling the operation of the fusing heater includes deactivating the fusing heater when the fusing temperature has reached the reference fusing temperature and introducing a print sheet into the fuser to perform a fusing process of the print sheet.

19. The method according to claim 15, further comprising:

converting an input image corresponding to the image to bitmap data;

calculating a transition rate of the bitmap data;

recognizing the print pattern of the input image from the transition rate and setting a reference fusing temperature according to the recognized print pattern;

detecting a fusing temperature changing as the fusing heater operates;

comparing the detected fusing temperature with the set reference fusing temperature; and controlling the fusing heater according to the comparison.

20. The method according to claim 19, wherein the transition rate is calculated using the number of dots and the number of transitions in the bit p data.

21. An image forming apparatus comprising:

an image forming unit to form an image and to transfer the formed image to a printing medium;

a fuser having a heater to fuse the transferred image on the printing medium; and a controller to control a heating time of the heater according to a recognized pattern within the image, wherein the controller includes a data processor to convert an input image to binary data and a transition rate calculator to calculate a transition rate from the binary data and to define the transition rate using the number of dots and the number of transitions of the input image according to the following formula:

Transition Rate=(Number of Transitions)/(Number of Dots).

22. The image forming apparatus according to claim 21, wherein the controller sets a heating temperature of the heater to reduce the heating time.

23. An image forming apparatus comprising:

an image forming unit to form an image at an image forming start time and to transfer the formed image to a printing medium;

a fuser having a heater to preheat the heater at a preheating start time and to fuse the transferred image on the printing medium; and a controller to control a difference between the preheating start time of the heater and the image forming start time of the image forming unit according to a recognized pattern within the image, wherein the controller includes a data processor to convert an input image to binary data and a transition rate calculator to calculate a transition rate from the binary data and to define the transition rate using the number of dots and the number of transitions of the input image according to the following formula:

Transition Rate=(Number of Transitions)/(Number of Dots).

24. The image forming apparatus according to claim 23, wherein the controller sets a heating temperature of the heater to reduce the difference.

* * * * *